US010326198B2

(12) United States Patent
Yikilmazcinar et al.

(10) Patent No.: US 10,326,198 B2
(45) Date of Patent: Jun. 18, 2019

(54) HOUSEHOLD APPLIANCE WIRELESS COMMUNICATION NETWORK ADAPTER

(71) Applicant: ARCELIK ANONIM SIRKETI, Istanbul (TR)

(72) Inventors: Sezgi Yikilmazcinar, Istanbul (TR); Mucahit Bacaksiz, Istanbul (TR); Selami Sevik, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 15/750,169

(22) PCT Filed: Aug. 6, 2015

(86) PCT No.: PCT/EP2015/068163
§ 371 (c)(1),
(2) Date: Feb. 2, 2018

(87) PCT Pub. No.: WO2017/020960
PCT Pub. Date: Feb. 9, 2017

(65) Prior Publication Data

US 2018/0233806 A1 Aug. 16, 2018

(51) Int. Cl.
*H01Q 1/24* (2006.01)
*H01Q 1/22* (2006.01)
(Continued)

(52) U.S. Cl.
CPC ..... *H01Q 1/24* (2013.01); *H01Q 1/22* (2013.01); *H01Q 1/48* (2013.01); *H01Q 11/04* (2013.01); *H01Q 19/30* (2013.01); *H01Q 21/12* (2013.01)

(58) Field of Classification Search
CPC .. H01Q 1/24; H01Q 1/22; H01Q 1/48; H01Q 11/04; H01Q 19/30; H01Q 21/12
See application file for complete search history.

(56) References Cited

U.S. PATENT DOCUMENTS 5,913,549 A 6/1999 Skladany
2009/0058732 A1* 3/2009 Nakano ..... H01Q 1/48 343/700 MS
(Continued)

FOREIGN PATENT DOCUMENTS

CN 103712406 A 4/2014
DE 3405879 A1 8/1985
(Continued)

OTHER PUBLICATIONS

International search report and written opinion, dated Apr. 13, 2016, of International Application No. PCT/EP2015/068163; 10 pgs.

*Primary Examiner* — Hoang V Nguyen
(74) *Attorney, Agent, or Firm* — Kilpatrick Townsend & Stockton LLP

(57) ABSTRACT

The present invention relates to a household appliance which can be remotely controlled by way of remotely connecting in a wireless communication network. The present invention more particularly relates to a household appliance with a network communication adapter improved in terms of its technical parameters. A household appliance is disclosed, comprising a wireless communication network adapter with an embedded planar antenna in the form of conductor lines integrated into a printed circuit board, the antenna comprising a radiating unit and a ground plane.

15 Claims, 1 Drawing Sheet

(51) Int. Cl.

| | |
|---|---|
| ***H01Q 1/48*** | (2006.01) |
| ***H01Q 19/30*** | (2006.01) |
| ***H01Q 11/04*** | (2006.01) |
| ***H01Q 21/12*** | (2006.01) |

(56) References Cited

U.S. PATENT DOCUMENTS

| | | | | |
|---|---|---|---|---|
| 2014/0137586 | A1 | 5/2014 | Mukherjee | |
| 2014/0174489 | A1 * | 6/2014 | Cottrell | A47L 15/0018 134/56 D |

FOREIGN PATENT DOCUMENTS

| | | | | |
|---|---|---|---|---|
| DE | 10060156 | A1 | 6/2002 | |
| DE | 102009000652 | A1 * | 8/2010 | F24C 7/082 |
| DE | 102010039058 | A1 * | 2/2012 | F24C 7/083 |

* cited by examiner

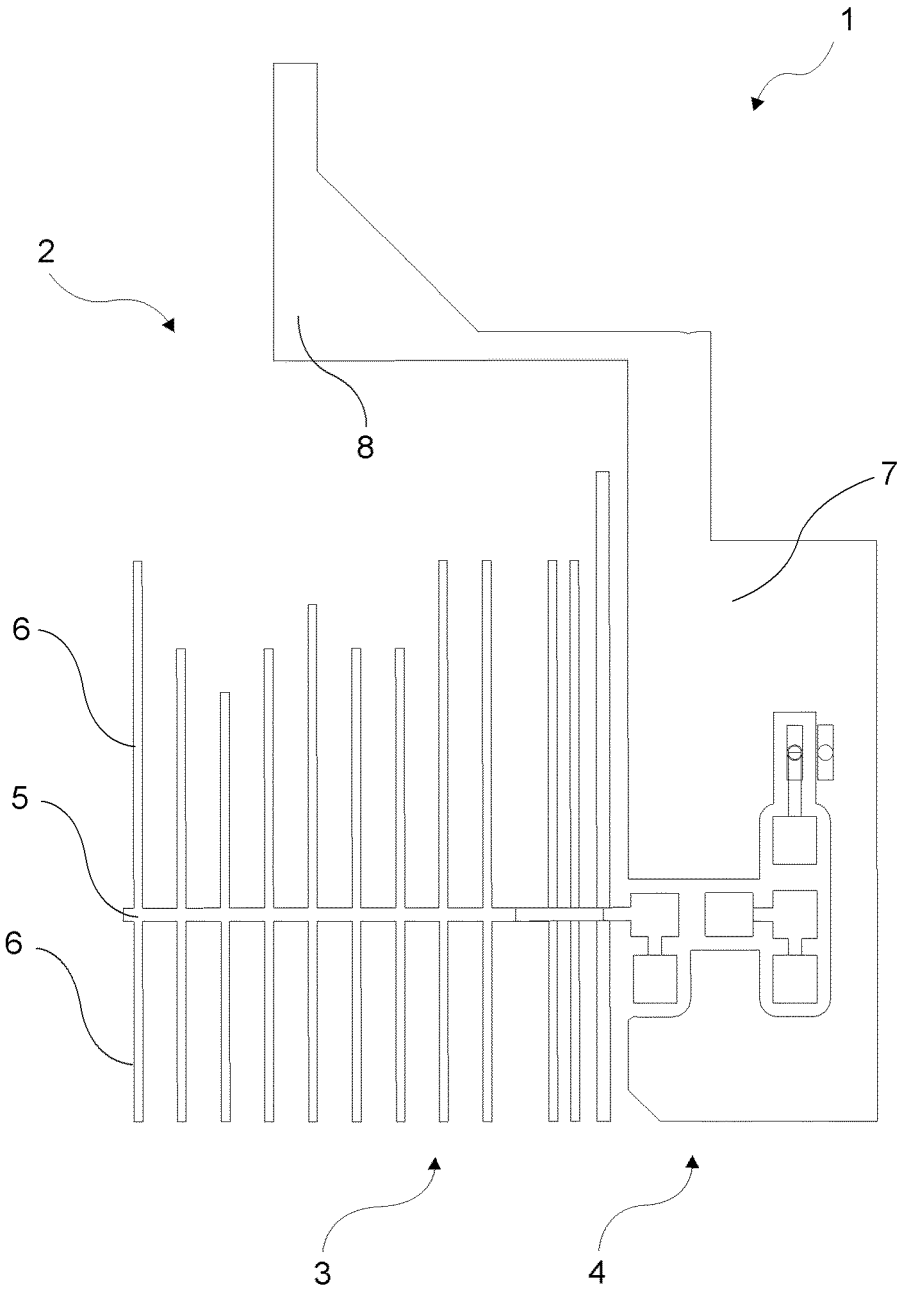
1
2
8
7
6
5
6
3
4

HOUSEHOLD APPLIANCE WIRELESS COMMUNICATION NETWORK ADAPTER

RELATED APPLICATIONS

This application is a U.S. National Phase of International Application No. PCT/EP2015/068163, filed Aug. 6, 2015, the entire disclosure of which is incorporated by reference herein.

The present invention relates to a household appliance which can be remotely controlled in a more intuitive manner from a remote location by way of remotely connecting to the same in a wireless communication network. The present invention more particularly relates to a household appliance with a network communication adapter improved in terms of its technical parameters.

Electrical household appliances such as laundry washing/drying machines, refrigerators, dishwashers or ovens have controls capable of performing different functions with physical keys or navigation arrows to select on-screen signs. It is well-known that such household appliances are also programmable to execute remotely programmed functions. For example, a laundry washing/drying machine can be programmed remotely through a network connection to fulfill certain tasks, such programming involving an improved computer interface for example as in the case of a special personal computer control interface or a smart phone application.

Further, household appliances connected to a home network can also perform additional practical functions or enable users to browse the Internet, stream media and or fulfill certain advanced functions as Internet-enabled smart devices through the use of a wireless connection.

The antenna is one of the principal components of wireless communication systems. One of the operational frequency bands in the IEEE 802.11 wireless communication system is defined as 2.400 MHz. Designing of small and low-cost compact antennas for household appliances requires consideration of a plurality of factors. On the other hand, the performance of the antenna itself plays a crucial role in the overall performance of the system. In an effort to reduce the size of the antenna, one should also consider performance problems associated with the reduced size, in which case propagation performance of the waves can be affected more by the surrounding obstacles and walls.

Among others, a prior art publication in the technical field of the invention may be referred to as CN103712406, which discloses a refrigerator with dual antennas and a refrigerator control method. The refrigerator comprises a refrigerator body and the antennas. The antennas include an internal antenna and an external antenna. The external antenna is mounted at the upper end, where metal shielding is avoided, of a refrigerator door, and mainly used for receiving and transmitting signals in the areas of the upper portion and the surrounding of the refrigerator. The internal antenna is mounted in a display screen of the refrigerator and mainly used for receiving and transmitting signals in the area of the front side of the refrigerator. The internal antenna and the external antenna are matched with each other to realize directivity compensation in signal receiving and transmitting.

The present invention provides a household appliance comprising a wireless communication network adapter with an embedded antenna as provided by the characterizing features defined in claim 1.

Primary object of the present invention is to provide a household appliance comprising a wireless communication network adapter with a compact, low-cost antenna providing improved propagation performance as well as radiation pattern. In summary, this invention includes improvements to antenna circuit designs.

The present invention proposes a household appliance in which a wireless communication network adapter has an integrated antenna within the printed circuit board (PCB). The antenna has a radiating unit and a ground plane such that the radiating unit's feeding line is configured to extend linearly so as to divide in non-equal portions unilinear auxiliary arms extending in perpendicular to the feeding line.

The ground plane has a first and a second portion with linear edges extending perpendicular to each other but respectively in parallel with the auxiliary arms and the feeding line.

Accompanying drawing is given solely for the purpose of exemplifying a household appliance comprising a wireless communication network adapter whose advantages over prior art were outlined above and will be explained in brief hereinafter.

The drawings are not meant to delimit the scope of protection as identified in the claims nor should they be referred to alone in an effort to interpret the scope identified in the claims without recourse to the technical disclosure in the description of the present invention.

FIG. 1 demonstrates a schematic top view of a part of the wireless communication network adapter comprising the antenna according to the present invention.

The following numerals are assigned to different part numbers used in the detailed description:

1. Network adapter
2. Antenna
3. Radiating unit
4. Ground plane
5. Feeding line
6. Auxiliary arm
7. First portion
8. Second portion The present invention proposes a household appliance comprising a wireless communication network adapter (1).

According to the present invention, an electrical household appliance (briefly a household appliance) such as a laundry washing/drying machine, a refrigerator, a dishwasher or an oven can be controlled by way of connecting to the appliance through a portable terminal. A mobile application running on the portable terminal can have a special interface dedicated to control various functions by performing a specific set of system operation functions. For instance a user can initiate a specific washing program defined for the specific product/model on the mobile application and transmit the specified set of actions to the appliance, upon which the appliance will execute the specified set of actions.

For instance a refrigerator or a laundry washing/drying machine may have a relatively basic user interface on which users set several operational parameters by means of buttons and knobs, but such interfaces may not involve a more advanced user input panel with a graphic screen interface or textual information inputting means such as a keyboard. A household appliance definable as a relatively low-budget appliance as well as an appliance having a more advanced control panel interface can remotely be controlled according to the invention.

It is to be noted that, apart from setting operational parameters of the appliance, the user can also remotely get updated information in respect of the operational status of the appliance at any time. The user can therefore monitor the operational status of the household appliance. For instance, when a selected washing program is initiated, the user can get detailed information in respect of the ongoing wash cycles and expected remaining durations from the mobile application by way of loading updated information. It is also to be noted that household appliances connected to a wireless network can perform additional functions or enable users to browse the Internet, stream media and or fulfill certain advanced functions as Internet-enabled smart devices.

The household appliance according to the present invention is conventionally equipped with a network board, or a network interface board, which is commonly referred to as a network adapter (1).

The household appliance may conventionally connect to a wireless (Wi-Fi) network by way of establishing a secure connection link with a wireless communication device, the network typically being a home network made up of several components such as computers, an Internet connection, and a wireless router. The wireless router conventionally acts as the center of the network as it shares the remote connection and other access to all connected devices. A portable terminal such as a cell phone, a smartphone or a personal digital assistant (PDA) can hence communicate with the appliance.

According to the present invention, the network adapter (1) comprises an embedded planar antenna in the form of conductor lines integrated into or fabricated on a printed circuit board (PCB trace antenna) as is known to the skilled worker. The antenna (2) conventionally comprises a radiating unit (3) and a ground plane (4) as will be disclosed hereinafter. Although a household appliance with a network adapter (1) is disclosed herein, the antenna (2) of the invention can also be used in different wireless units including wireless sensor networks nodes, communication devices, wireless measuring devices etc.

The overall size of an antenna (2) is mainly dependent on the wavelength of the resonating frequency. The dipole antenna being an antenna comprising two radiating units, the antenna (2) of the invention has only one radiating unit (4) and although being a monopole antenna as such conventionally behaves as a dipole antenna due to the ground plane (4). The ground plane (4) is a conducting surface large enough in comparison to the wavelength, which is defined in the range of 10.3 to 13 cm according to the present invention. The proposed network adapter (1) operating in a frequency range of 2.36 to 2.9 GHz supports network modes belonging to the 802.11 family.

According to the present invention, the radiating unit (3) conventionally has a feeding line (5) in the form of a linear extension with a plurality of perpendicular auxiliary arms (6) on both sides thereof. In other words, the feeding line (5) creates a plurality of non-symmetrical auxiliary arms (6) on both sides thereof. While the auxiliary arms (6) on a first side of the feeding line (5) have fixed lengths, the auxiliary arms (6) on a second side of the feeding line (5) have variable lengths. The distance between neighboring auxiliary arms (6) through the feeding line (5) is constant with the exception of the first four pairs of auxiliary arms (6) proximate the ground plane (4) on the direction of the feeding line (5). According to the present invention, the antenna (2) and the ground plane (4) are etched from a copper PCB. They can also be printed or manufactured to be attachable to the PCB. The antenna (2) can preferably be placed on a substrate, the two then being attached to the circuit board. Internal antennas are affected by the physical form of the ground plane (4) that the antenna operates with. The ground plane (4) can be a homogeneous area of copper in the form of a PCB mass layer.

Further, the ground plane (4) according to the present invention has a first portion (7) and a second portion (8); while the edge of the first portion (7) extends parallel to the auxiliary arms (6), the edge of the second portion (8) being perpendicular to the edge of the first portion extends parallel to the feeding line (5). This arrangement ensures that the antenna (2) performance is optimized as different radiating sections of the antenna (2), i.e. the auxiliary arms (6) and the feeding line (5) provide a double polarization effect improving communication quality. The feeding line (5) and the auxiliary arms (6) are oriented substantially perpendicular to each other and the feeding line (5), the auxiliary arms (6) and the ground plane (4) are oriented in a common plane.

According to the present invention, the edge of the ground plane (4) first portion (7) is longer than the edge of the ground plane (4) second portion (8) and while the feeding line (5) extends parallel to the shorter second portion (8) edge, the auxiliary arms (6) extend parallel to the longer first portion (7) edge, thereby constituting an additional configuration in the optimization of the antenna (2) performance.

Therefore, the PCB of the wireless communication network adapter (1) of the invention can provide the ground plane (4) function. The antenna (2) impedance is optimized by adjusting length and or width of a plurality of open-end portions between auxiliary arms (6) so as to generate a capacitive reactance effective in impedance matching.

As mentioned above, to optimize the antenna (2) radiating unit (3) portions, the following dimensional arrangements are realized: The length of the first pair of unilinear auxiliary arms (6) closest to the first portion (7) edge of the ground plane (4) is 14,911 mm whereas the length of the feeding line (5) is 12,180 mm. While the distance between the first four pairs of unilinear auxiliary arms (6) closest to the first portion (7) edge of the ground plane (4) is not constant, the in-between distance between remaining neighboring auxiliary arms (6) along the axis of the feeding line (5) is constantly 0.80 mm. While the width of the auxiliary arms (6) is 0.20 mm with the exception of the first pair of unilinear auxiliary arms (6) closest to the first portion (7) edge of the ground plane (4), the width of the feeding line (5) and the first pair of unilinear auxiliary arms (6) is 0.30 mm.

Further, the length of the shortest pair of unilinear auxiliary arms (6) is 9,858 mm and the length of at least one pair of unilinear auxiliary arms (6) is 12,850 mm, 11,858 mm or 10,858 mm. The distance of the closest point of the first pair of unilinear auxiliary arms (6) to the second portion (8) edge of the ground plane (4) is 2,545 mm and the distance of the first pair of unilinear auxiliary arms (6) to the first portion (7) edge of the ground plane (4) is 0,324 mm. Therefore, the capacitance and inductance to match the antenna (2) to the desired frequency range is accomplished by way of configuring the shape and geometry of the antenna (2).

Although a network adapter (1) is disclosed herein, the antenna (2) of the invention can be used in different wireless units including wireless sensor network nodes, communication devices, wireless measuring devices such as heating control units, humidity control units, alarm systems etc.

In summary, the present invention proposes an electrical household appliance comprising a wireless communication network adapter (1) with an embedded planar antenna (2) in the form of conductor lines integrated into a printed circuit board (PCB), the antenna (2) comprising a radiating unit (3) and a ground plane (4).

In one embodiment of the present invention, the radiating unit (3) has a feeding line (5) in the form of a linear extension with a plurality of auxiliary arms (6) on both sides thereof.

In a further embodiment of the present invention, the ground plane (4) has a first portion (7) and a second portion (8), the edge of the first portion (7) extending parallel to the auxiliary arms (6) and the edge of the second portion (8) extending parallel to the feeding line (5).

In a further embodiment of the present invention, the plurality of auxiliary arms (6) extends in perpendicular to the feeding line (5).

In a further embodiment of the present invention, the feeding line (5) creates a plurality of non-symmetrical unilinear auxiliary arms (6) of different lengths on both sides thereof.

In a further embodiment of the present invention, the auxiliary arms (6) on a first side of the feeding line (5) have fixed lengths and the auxiliary arms (6) on a second side of the feeding line (5) have variable lengths.

In a further embodiment of the present invention, the distance between neighboring auxiliary arms (6) through the feeding line (5) is constant.

In a further embodiment of the present invention, the distance between the neighboring first four pairs of auxiliary arms (6) proximate the ground plane (4) on the direction of the feeding line (5) is variable.

In a further embodiment of the present invention, the feeding line (5), the auxiliary arms (6) and the ground plane (4) are oriented in a common plane.

In a further embodiment of the present invention, the edge of the ground plane (4) first portion (7) is longer than the edge of the ground plane (4) second portion (8).

In a further embodiment of the present invention, the feeding line (5) extends parallel to the shorter second portion (8) edge and the auxiliary arms (6) extends parallel to the longer first portion (7) edge.

In a further embodiment of the present invention, the length of the first pair of unilinear auxiliary arms (6) closest to the first portion (7) edge of the ground plane (4) is in the range of 13.4 to 16.4 mm.

In a further embodiment of the present invention, the length of the feeding line (5) is in the range of 11 to 13.4 mm.

In a further embodiment of the present invention, the in-between distance between neighboring auxiliary arms (6) along the axis of the feeding line (5) other than the first four pairs of auxiliary arms (6) proximate the ground plane (4) is in the range of 0.7 to 0.9 mm.

In a further embodiment of the present invention, the width of the auxiliary arms (6) other than the first pair of unilinear auxiliary arms (6) closest to the first portion (7) edge of the ground plane (4) through the feeding line (5) is in the range of 0.18 to 0.22 mm and the width of the feeding line (5) and the first pair of unilinear auxiliary arms (6) is in the range of 0.27 to 0.33 mm.

In a further embodiment of the present invention, the length of the shortest pair of unilinear auxiliary arms (6) is in the range of 8.9 to 10.8 mm and the length of at least one pair of unilinear auxiliary arms (6) is in the range of 9.8 to 14.1 mm.

In a further embodiment of the present invention, the distance of the closest point of the first pair of unilinear auxiliary arms (6) to the second portion (8) edge of the ground plane (4) is in the range of 2.3 to 2.8 mm and the distance of the first pair of unilinear auxiliary arms (6) to the first portion (7) edge of the ground plane (4) is in the range of 0.3 to 0.4 mm.

It is to be noted that reflection and radiation pattern of the antenna (2) according to the present invention were measured to verify the performance thereof. The antenna is verified to produce an omnidirectional radiation pattern due to the asymmetric dipole type structure of the antenna (2). Maximum gain is measured to be +2.38 dB with a total efficiency of around 90%. The antenna (2) is operational over a frequency range of 2.4 to 2.85 GHz. Therefore, the present invention advantageously provides a low-loss optimized radiation characteristics antenna (2).

The invention claimed is:

1. A household appliance comprising a wireless communication network adapter with an embedded planar antenna in form of conductor lines integrated into a printed circuit board, the antenna comprising a radiating unit and a ground plane, wherein the radiating unit has a feeding line in form of a linear extension with a plurality of auxiliary arms on both sides thereof; and the ground plane has a first portion and a second portion, an edge of the first portion extending parallel to the auxiliary arms and the edge of the second portion extending parallel to the feeding line.

2. The household appliance as in claim 1, wherein the plurality of auxiliary arms extend in perpendicular to the feeding line.

3. The household appliance as in claim 1, wherein the feeding line creates a plurality of non-symmetrical unilinear auxiliary arms of different lengths on both sides thereof.

4. The household appliance as in claim 3, wherein the auxiliary arms on a first side of the feeding line have fixed lengths and the auxiliary arms on a second side of the feeding line have variable lengths.

5. The household appliance as in claim 3, wherein the distance between neighboring auxiliary arms through the feeding line is constant.

6. The household appliance as in claim 5, wherein the in-between distance between neighboring auxiliary arms along the axis of the feeding line other than the first four pairs of auxiliary arms proximate the ground plane is in the range of 0.7 to 0.9 mm.

7. The household appliance as in claim 3, wherein the distance between the neighboring first four pairs of auxiliary arms proximate the ground plane on the direction of the feeding line is variable.

8. The household appliance as in claim 3, wherein the length of the first pair of unilinear auxiliary arms closest to the first portion edge of the ground plane is in the range of 13.4 to 16.4 mm.

9. The household appliance as in claim 3, wherein the width of the auxiliary arms other than the first pair of unilinear auxiliary arms closest to the first portion edge of the ground plane through the feeding line is in the range of 0.18 to 0.22 mm and the width of the feeding line and the first pair of unilinear auxiliary arms is in the range of 0.27 to 0.33 mm.

10. The household appliance as in claim 3, wherein the length of the shortest pair of unilinear auxiliary arms is in the range of 8.9 to 10.8 mm and the length of at least one pair of unilinear auxiliary arms is in the range of 9.8 to 14.1 mm.

11. The household appliance as in claim 3, wherein the distance of the closest point of the first pair of unilinear auxiliary arms to the second portion edge of the ground plane is in the range of 2.3 to 2.8 mm and the distance of said first pair of unilinear auxiliary arms to the first portion edge of the ground plane is in the range of 0.3 to 0.4 mm.

12. The household appliance as in claim 1, wherein the feeding line, the auxiliary arms and the ground plane are oriented in a common plane.

13. The household appliance as in claim 1, wherein the edge of the ground plane first portion is longer than the edge of the ground plane second portion.

14. The household appliance as in claim 13, wherein the feeding line extends parallel to the shorter second portion edge and the auxiliary arms extends parallel to the longer first portion edge.

15. The household appliance as in claim 1, wherein the length of the feeding line is in the range of 11 to 13.4 mm.

* * * * *